US005097980A

United States Patent [19]

Warwick

[11] Patent Number: 5,097,980

[45] Date of Patent: Mar. 24, 1992

[54] CRATE

[75] Inventor: Michael J. Warwick, Transvaal Province, South Africa

[73] Assignee: Teknol Holdings, Inc., St. Heller, Channel Islands

[21] Appl. No.: 758,169

[22] Filed: Sep. 11, 1991

Related U.S. Application Data

[63] Continuation of Ser. No. 570,158, Aug. 17, 1990, abandoned.

[30] Foreign Application Priority Data

Aug. 21, 1989 [ZA] South Africa ..... 89/6373

[51] Int. Cl.[5] ..... B65D 1/24; B65D 21/00

[52] U.S. Cl. ..... 220/510; 220/512; 206/503; 206/427

[58] Field of Search ..... 206/510, 509, 503, 427; 220/507, 529, 512

[56] References Cited

U.S. PATENT DOCUMENTS

| | | | |
|---|---|---|---|
| D. 169,743 | 6/1953 | Fritz, Jr. et al. | 206/503 |
| 2,512,855 | 6/1950 | Erickson | 220/21 |
| 2,535,113 | 12/1950 | Acton | 224/48 |
| 2,535,114 | 12/1950 | Acton | 224/48 |
| 2,574,983 | 11/1951 | Reed | 220/21 |
| 2,886,202 | 5/1959 | Waller | 220/21 |
| 2,960,134 | 11/1960 | Fornas | 206/503 |
| 3,106,308 | 10/1963 | Kazimier . | |
| 3,155,268 | 11/1964 | Fogerty et al. | 220/21 |
| 3,160,306 | 12/1964 | Smalley | 220/9 |
| 3,332,574 | 7/1967 | Earp | 220/97 |
| 3,353,704 | 11/1967 | Belcher et al. | 220/21 |
| 3,368,709 | 2/1968 | Waller | 220/21 |
| 3,643,812 | 2/1972 | Mander et al. . | |
| 3,752,385 | 8/1973 | Woodgate . | |
| 3,762,594 | 10/1973 | Utz | 220/21 |
| 4,093,101 | 6/1978 | Braun . | |
| 4,190,172 | 2/1980 | Box . | |
| 4,499,997 | 2/1985 | Swingley . | |

FOREIGN PATENT DOCUMENTS

| | | | |
|---|---|---|---|
| 695171 | 9/1964 | Canada . | |
| 2312871 | 10/1973 | Fed. Rep. of Germany | 933/72 |
| 2903163 | 8/1979 | Fed. Rep. of Germany . | |
| 6508637 | 1/1966 | Netherlands | 206/503 |
| 130018 | 6/1962 | New Zealand . | |
| 1297456 | 11/1972 | United Kingdom . | |
| 1342806 | 1/1974 | United Kingdom . | |
| 1373115 | 11/1974 | United Kingdom . | |
| 2158044 | 11/1985 | United Kingdom . | |

*Primary Examiner*—Joseph Man-Fu Moy
*Attorney, Agent, or Firm*—Marshall A. Lerner

[57] ABSTRACT

A crate has a thin-walled body defining a cavity for receiving a plurality of containers and a base on which the containers can be supported. The crate also has a crate insert located wholly or substantially wholly in the cavity of the body. The insert provides a spacer arrangement suitably above the floor of the body for separating containers in the crate from one another in normal use. The crate insert has load-bearing pillars for forming part of a composite load bearing pillar construction with pillars of lower and higher crates of a substantially identical construction when the crate is located in a stack of crates. The insert may be secured to the crate body by locating formalities.

17 Claims, 9 Drawing Sheets

CRATE

This is a continuation of copending application Ser. No. 07/570,158 filed on Aug. 17, 1990, now abandoned.

This invention relates to crates.

The applicant has previously developed a crate having a body with a cavity for receiving a plurality of containers and with a floor structure on which the containers can be supported; and also having a crate insert providing a spacer arrangement located in the cavity of the body above the floor of the body for separating containers in the crate.

The crate body was made as a relatively thin-walled body of plastics material, which could flex excessively if it alone was used for carrying containers. Partitions or webs provided in the lower part of the crate would not always stabilize the body sufficiently in normal use the and spacer arrangement was suitably rigid to restrain excessive flexing of the crate when carrying full containers.

The body and crate insert were provided with complementary formations for enabling the crate insert to be secured to the body at various locations for further strengthening the crate.

However, the crate was found to lack the stacking capabilities which were at times required for substantial stacks of crates.

The applicant, however, wished to avoid partitions from the floor to the top of the crate and dividing the crate into individual compartments because of the usually high material content of those partitions.

The applicant became aware of other crates with inserts but these did not appear to provide the stacking characteristics, ease of manufacture, and light weight body construction required by the applicant. Examples of these crates are shown in U.S. Pat. Nos. 2,512,855, 3,368,709, 3,643,812, 2,535,113, 3,762,594, 2,574,983, 3,160,306, 3,752,385 and 4,190,172 and German OS 2 312 871 for example.

According to the present invention, there is provided a crate having a body defining a cavity for receiving a plurality of containers and including a base on which the containers can be supported; the crate also including a crate insert located wholly or substantially wholly in the cavity of the body and providing a spacer arrangement suitably above the floor of the body for separating containers in the crate from one another in normal use, the crate insert having load-bearing pillars for forming part of a composite load bearing pillar construction with pillars of lower and higher crates of a substantially identical construction when the crate is located in a stack of such crates.

The spacer arrangement of the crate insert may be located in the upper half of the crate and may alone or together with the body define openings for receiving containers. Where the openings are defined by both the body and the insert, the crate insert will border only part of any opening. However, where openings are provided completely by the spacer arrangement, the spacer arrangement may be designed to completely encircle the containers in those openings.

It will be appreciated that the crate may be particularly suited for receiving containers in the form of bottles.

If the crate body is made as a relatively thin-walled body of plastic material, the body may flex excessively if it is used alone for carrying containers. Partitions or webs provided in the lower part of the crate may not stabilize the body sufficiently in normal use. A suitable crate insert can be suitably rigid to restrain excessive flexing of the body when the crate is carrying full containers even if it is also of a relatively thin-walled plastic material. For this purpose, the crate insert may be shaped so that, where it extends from one wall of the crate body to another, it is reinforced to provide the body with suitable support against flexing.

The body and the crate insert may be provided with complementary formations for enabling the crate insert to be secured to the body at various locations for further strengthening the crate. These formations can also serve to locate the load bearing pillars. For example, the load-bearing pillars may be designed to extend over a substantial part of the height of the body and the body may have formations for engaging or locating formations on the pillars at least in the upper and lower regions of the crate, and possibly up substantially the whole of the height of the pillars, to locate the pillars with respect to the body.

The pillars may rest on the floor of the body, in which case the floor may have support zones which help to locate the insert with respect to the body and support the pillars. These support zones may also be designed to rest on top of pillars of subjacent crates to enable the pillars to serve their purposes of at least partly carrying higher crates. Alternatively, the body and insert may have locating formations capable of retaining the insert at a particular position in the crate with the bottoms of the pillars exposed through openings in the crate so that they can engage pillars of a subjacent crate and be supported when the crate is stacked on the subjacent crate.

The pillars, optionally with certain parts of the body, may thus provide the pillar constructions and form supporting columns for carrying higher crates when the crate is stacked with other crates.

The floor of the crate may be part of a base including suitable web formations for inhibiting sagging of the base.

An embodiment of the invention will now be described, by way of example, with reference to the accompanying schematic drawings, in which FIG. 1 is a very basic three-dimensional representation of a symmetrically constructed crate according to the invention, no detail being shown;

Figure 1:
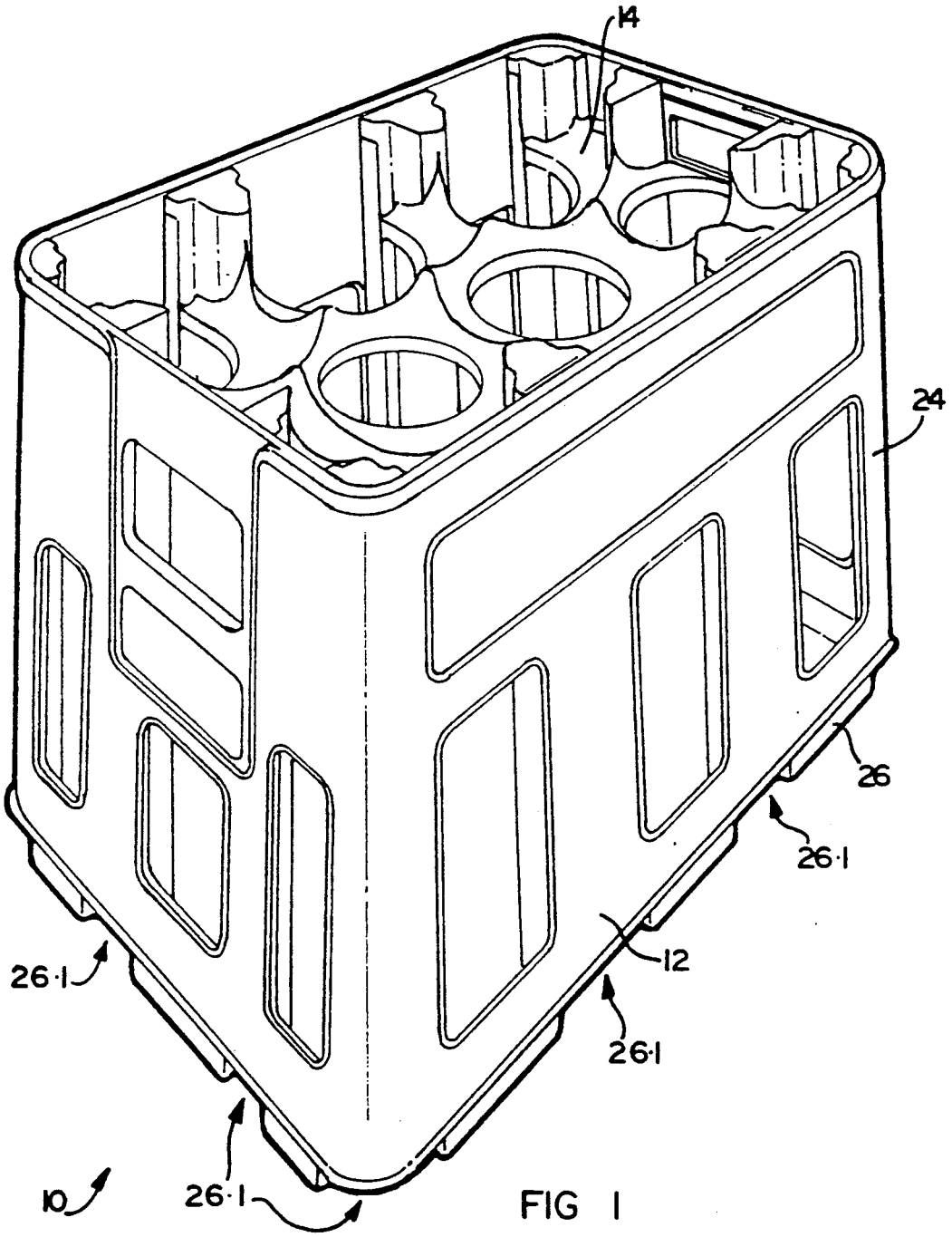
Figure 2:
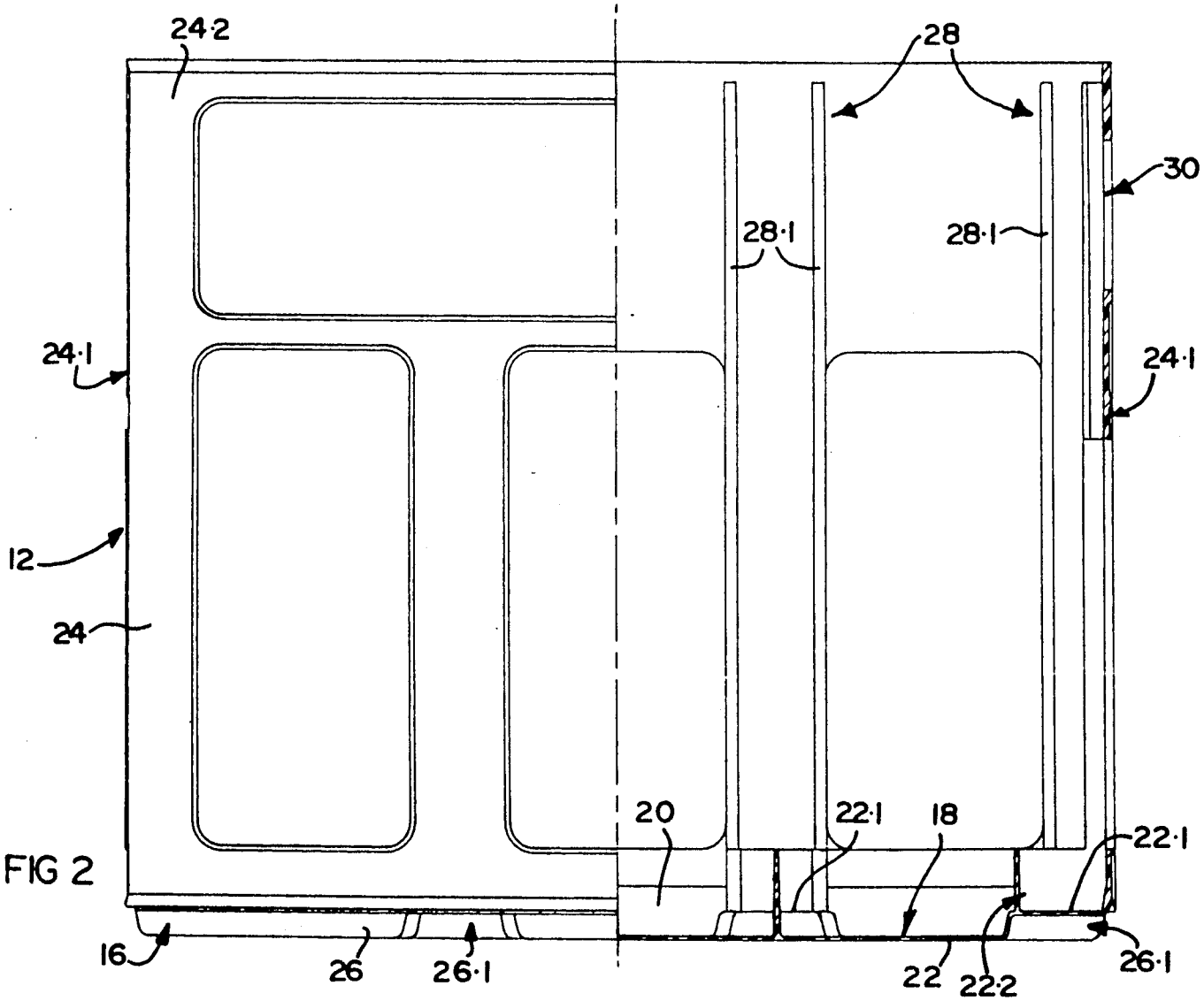
FIG. 2 is a side elevation of a body of the crate of FIG. 1 with the right hand side of the crate shown in cross-section on line II—II in FIG. 4.
Figure 3:
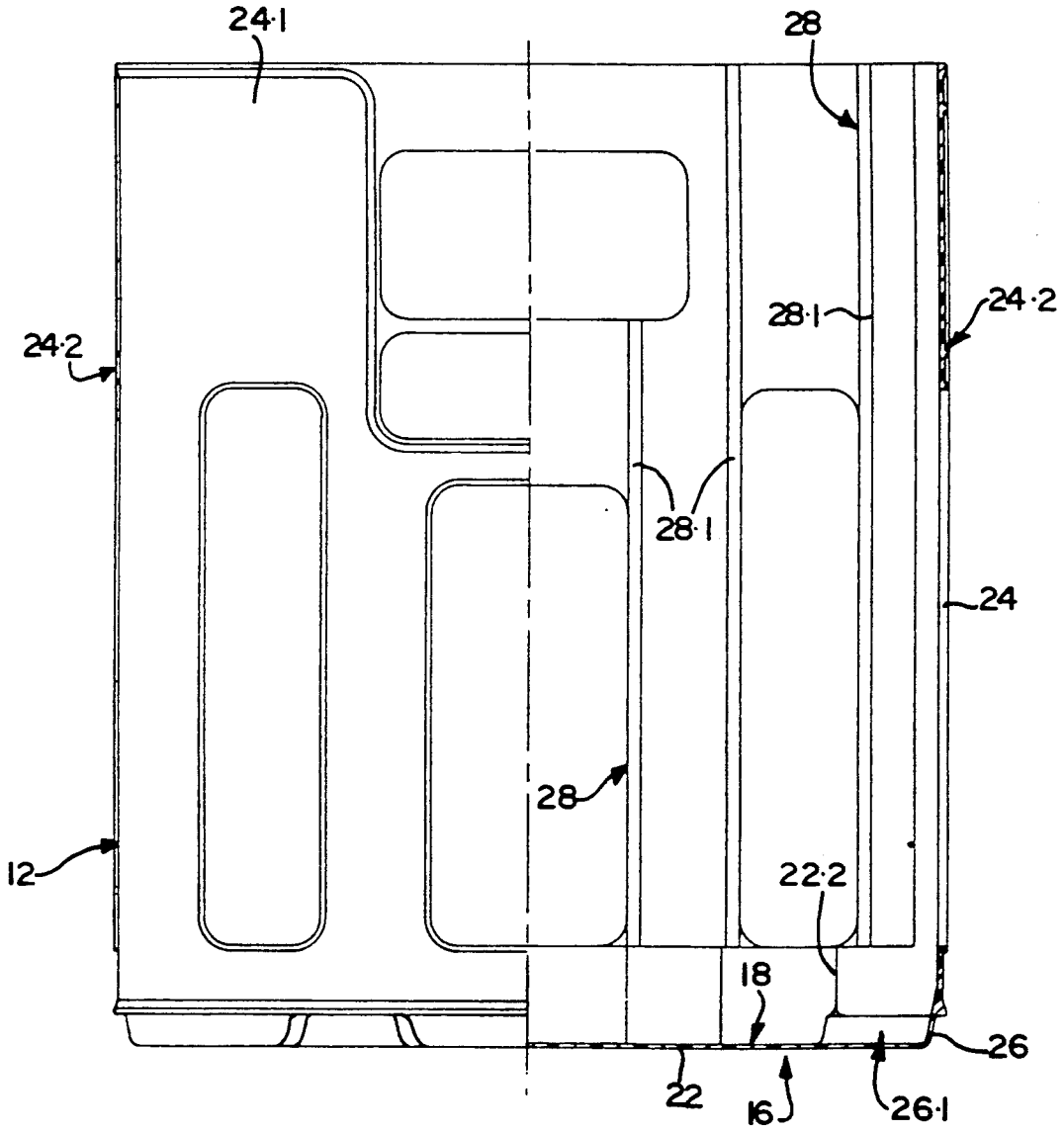
FIG. 3 is an end elevation of the body of the crate with the right hand side of the crate shown in cross-section on III—III in FIG. 4.
Figure 4:
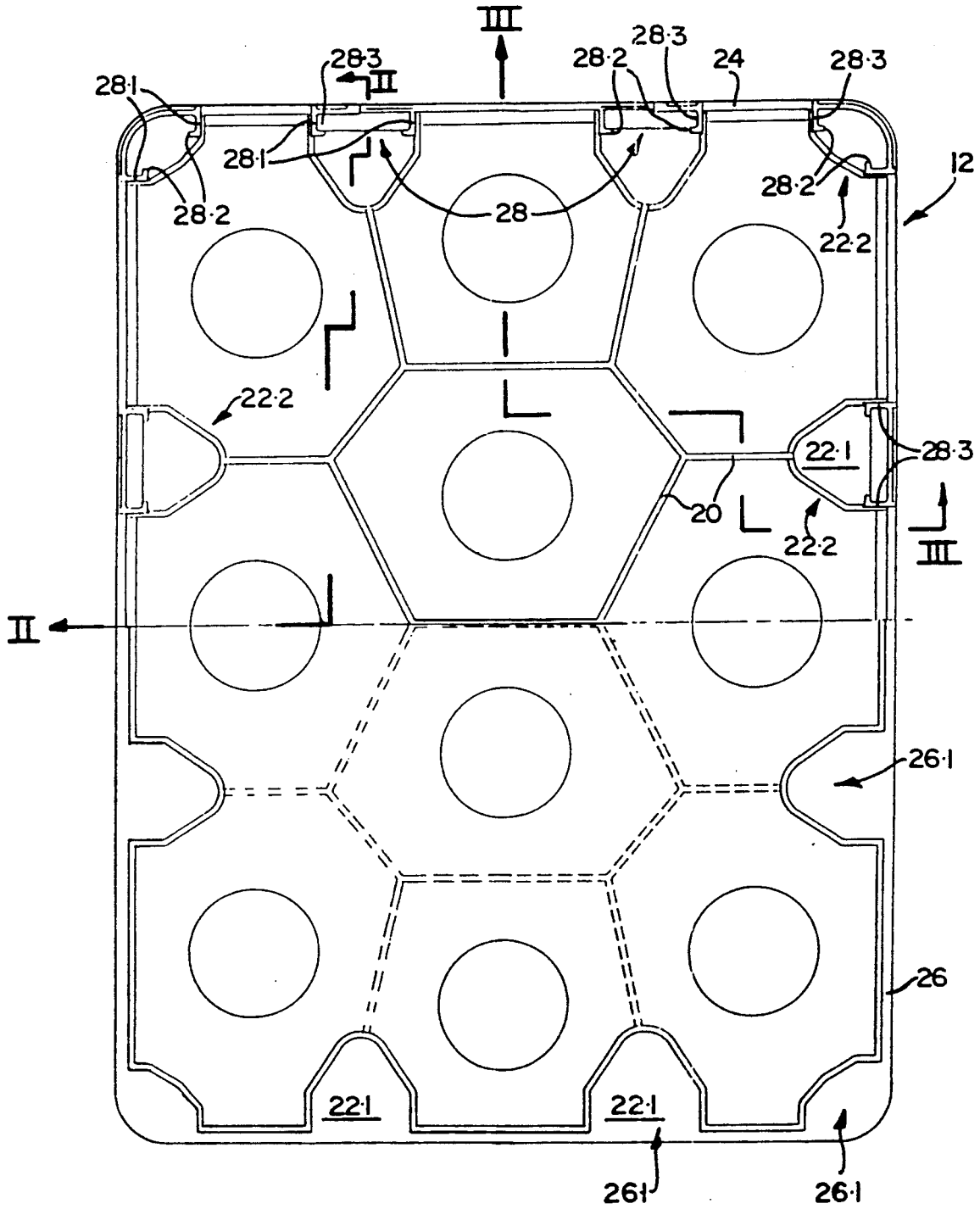
FIG. 4 is a plan and underplan view of the body with the right hand side showing an underplan view of half of the crate and the left hand side showing a plan view of half of the crate.

Referring to the drawing in more detail, a bottle crate 10 comprises a one part moulded plastic body 12 and a one part moulded plastic crate insert 14. The body 12 has a base 16 providing floor surfaces 18 on a floor 22 for supporting bottles located in the crate.

The floor 22 is a substantially flat floor connected to a peripheral wall structure 24 of the body by a peripheral inclined connecting strip 26. At uniformly spaced locations 26.1 the connecting strip 26 is recessed so that support zones in the form of flat platforms 22.1 are formed above the floor 23 at predetermined locations around the periphery of the body.

The base is provided with webs 20 forming a honeycomblike grid integral with the floor and the wall structure 24. The grid serves to inhibit sagging of the base and also serves to separate the bottoms of bottles received in the crate.

The peripheral wall 24 is substantially rectangular in plan view and comprises end walls 24.1 and side walls 24.2 connected by rounded corners. Openings are formed in the walls to reduce the mass of the body. In addition, hand grip openings 30 are provided in the end walls 24.1 to enable the crate to be lifted.

The body is provided with locating formations 28 above the platforms 22.1 These locating formations comprise parts of parallel L-shaped ribs 28.1 extending upwardly away from the platforms with the ribs of each pair having inwardly directed flanges 28.2 so that grooves 28,3 are defined between the wall 24 and the flanges. These grooves extend over substantially the whole height of the body above the platforms 22.1 except in the region of the hand grip openings 30, where one of the ribs is terminated at the bottom of the hand grip opening.

It will be seen that the body is thus a one-part moulded unit and it may be relatively thin-walled. However, as the walls of the crate area made primarily from a single layer of plastics material, the body may flex excessively when used to carry full bottles. It is therefore desirable to strengthen the crate. It is also necessary to enable the crate to be stacked and to support higher crates in a stack. In addition, it is also desirable to make provision for keeping the upper parts of the bottles apart. For these purposes, the crate insert 14 is used.

Figure 5:
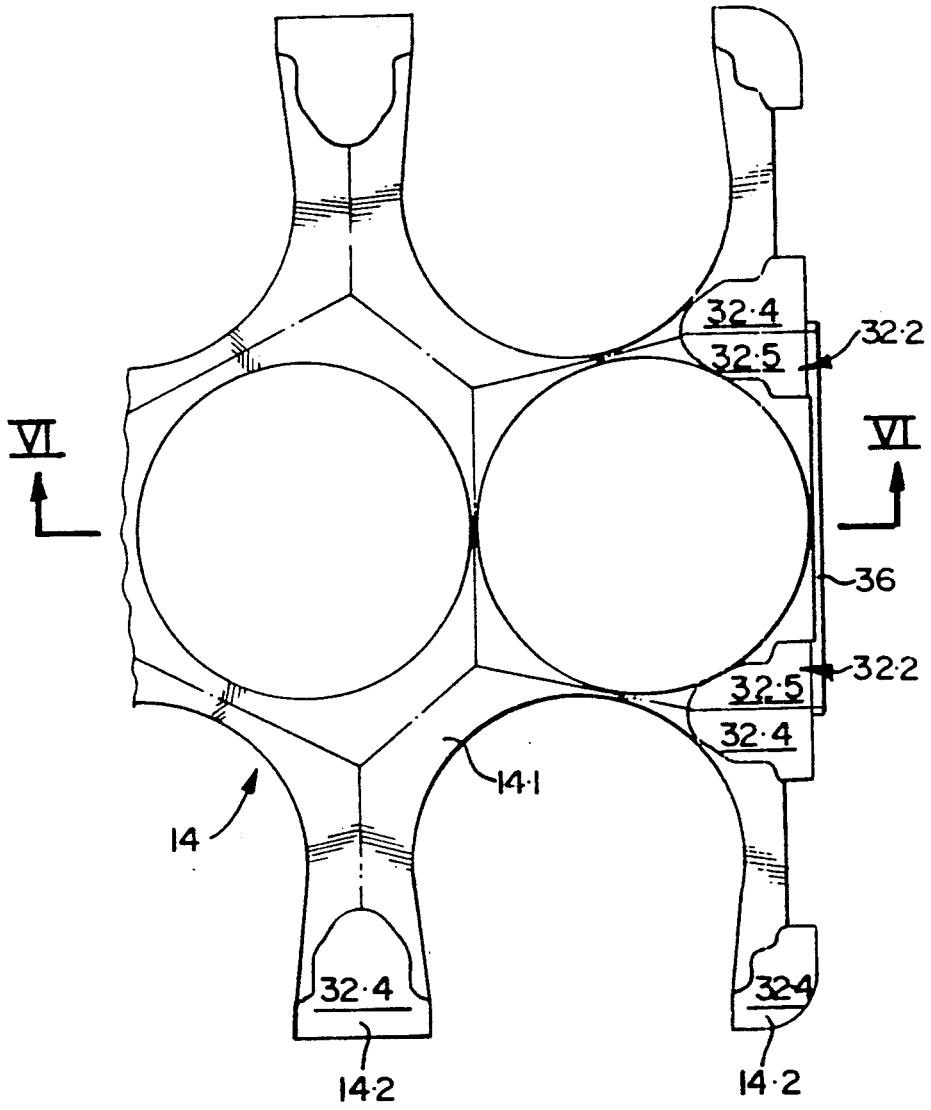
FIG. 5 is a half plan view of a crate insert of the crate.
Figure 6:
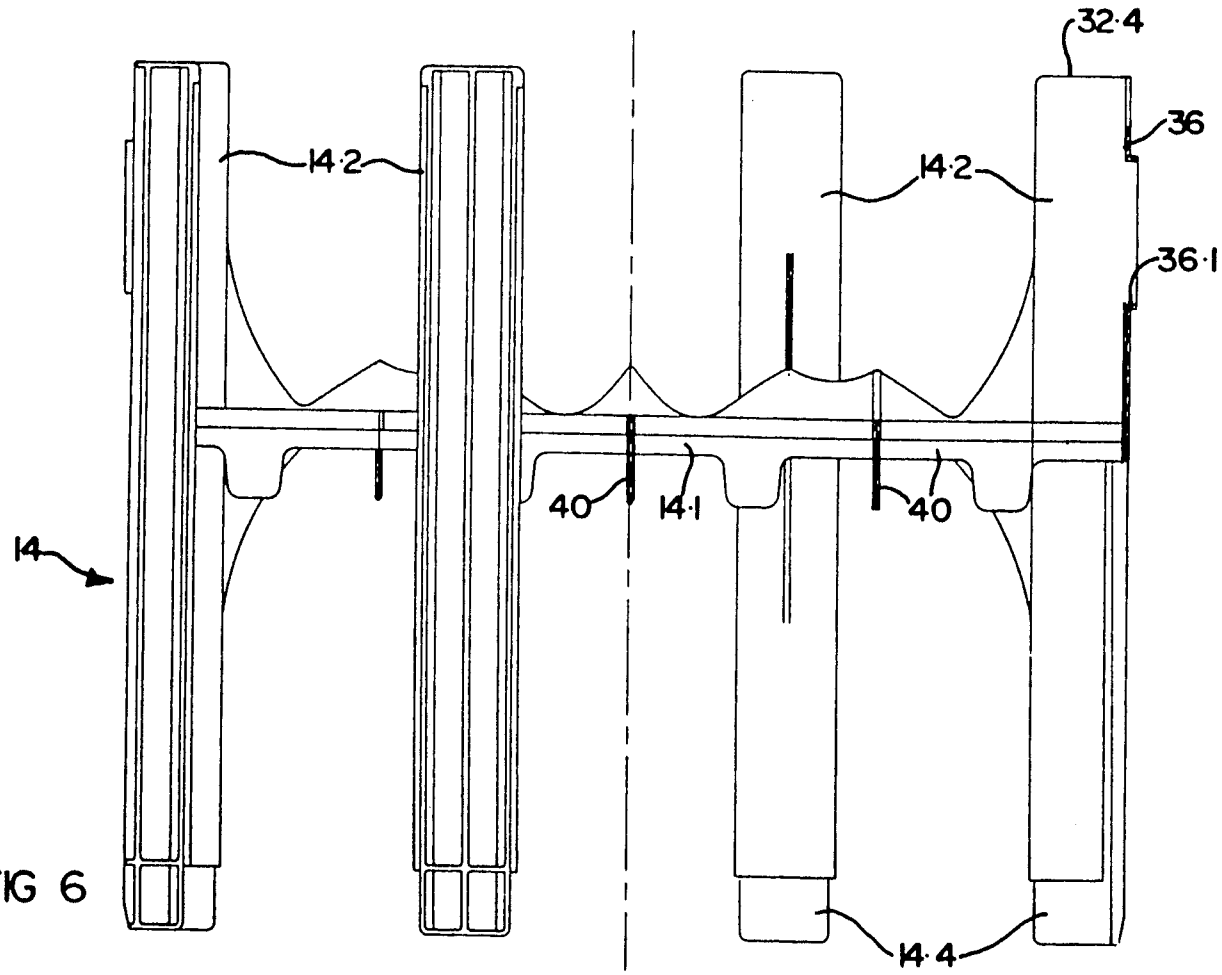
FIG. 6 is a side elevation of the crate insert with the right hand side shown in cross-section VI—VI in FIG. 5.
Figure 9:
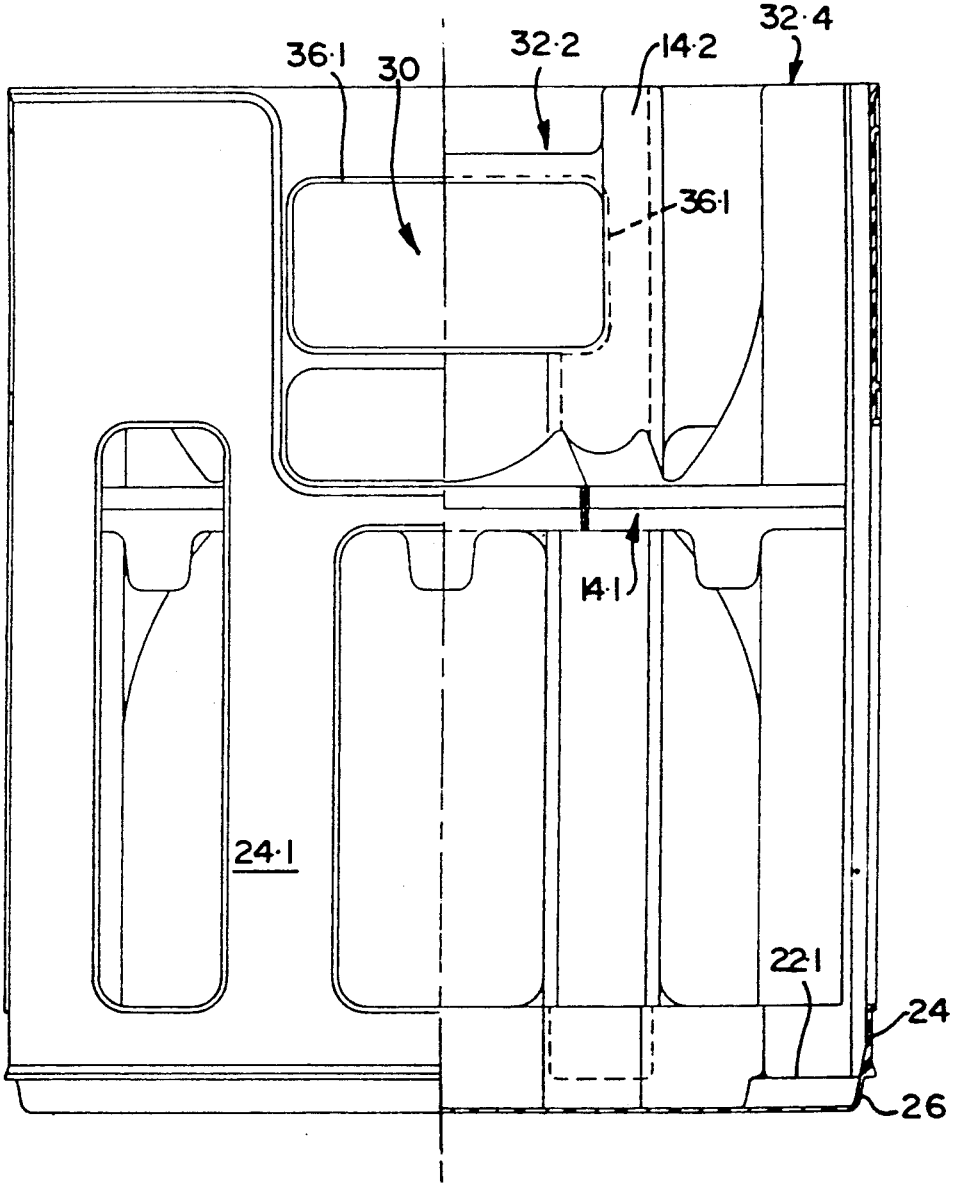
FIG. 9 is an end elevation of the crate with the right hand side of the crate being a cross-section on line IX—IX in FIG. 7.

The crate insert has a spacer arrangement 14.1 and pillars 14.2, as shown in FIGS. 5 and 6. The pillars are provided with locating formations 32 extending up the height of the pillars. Each of these locating formations 32 is provided by forming a pair of vertically extending grooves 32.1 in and at the opposite sides of the respective pillar. This creates two outwardly directed grooves on opposite sides of each pillar as shown in FIG. 5. Where the pillars which fit against the end walls 24.1 border the hand grip openings 30, the pillars are partly omitted at 32.3, as shown in FIGS. 5 and 9, so that the grooves 32.1 to fit beneath the hand grip openings are relatively short. The pillars 14.2 are hollow pillars closed at their upper ends by platforms 32.4 (and 32.5 in the case of the pillar parts beneath the hand grip openings) and internally reinforced by webs 34. The platforms 32.4 and 32.5 have been omitted in FIG. 7 so that the grooves 32.1 and webs can be seen.

Figure 7:
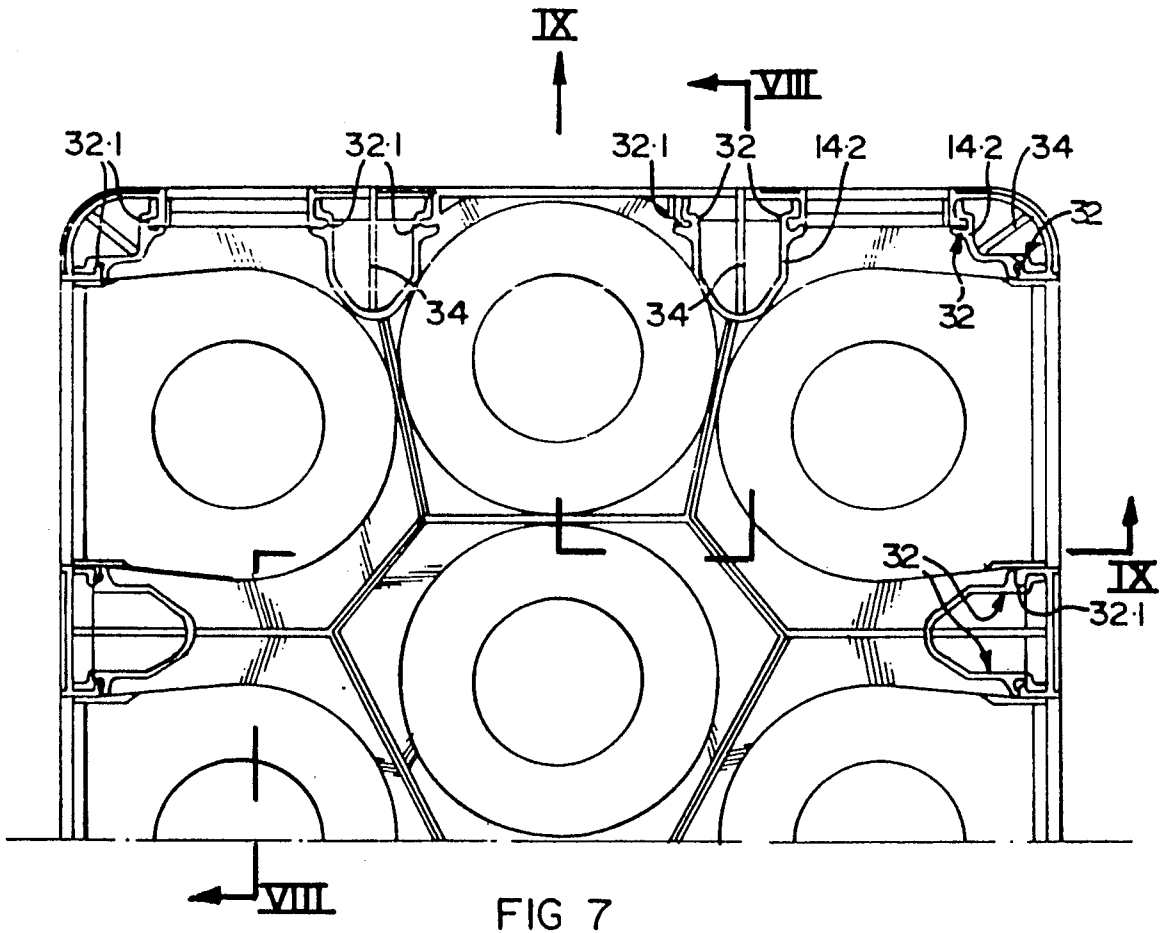
FIG. 7 is a half plan view showing the insert located and secured in the body of the crate.
Figure 8:
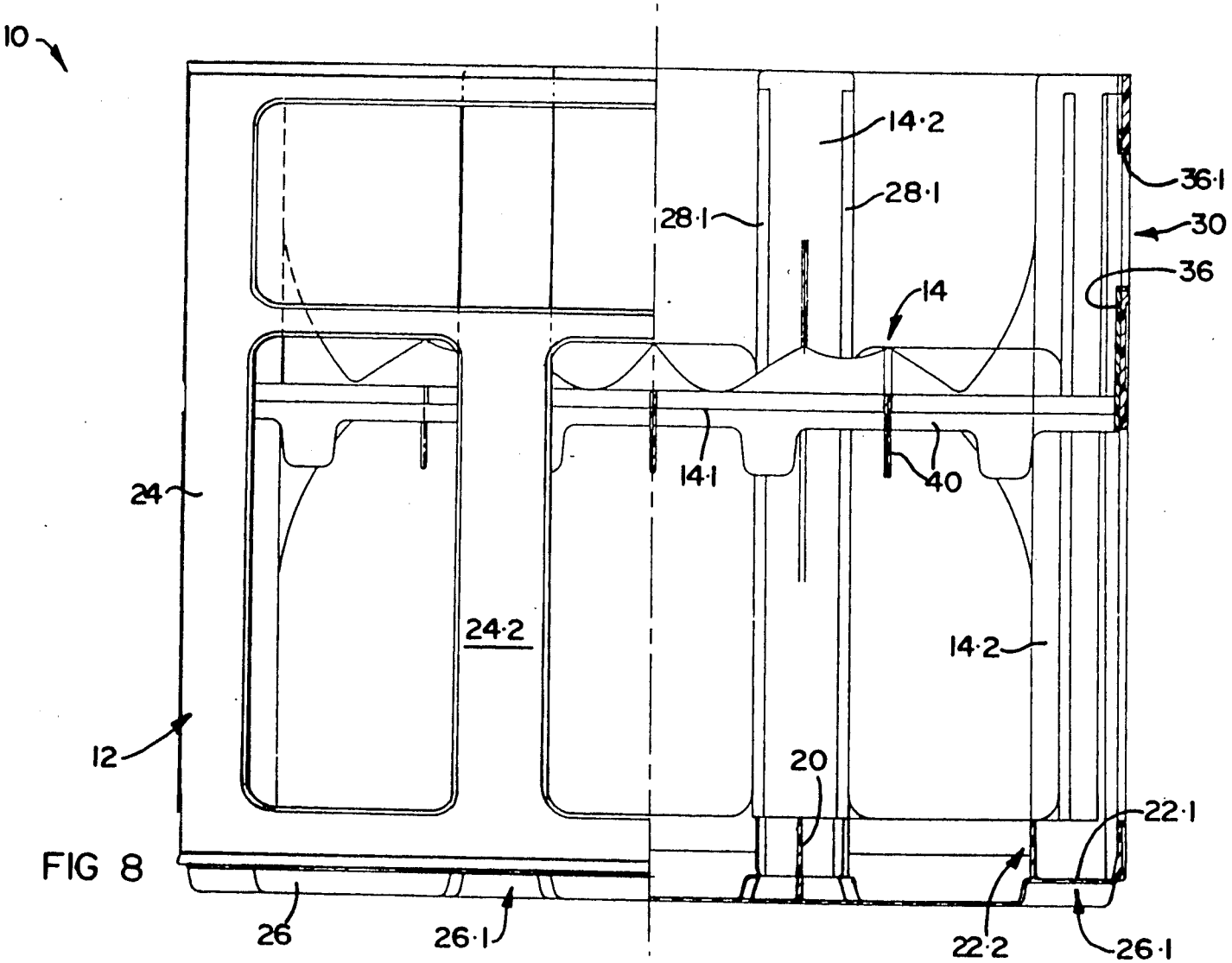
FIG. 8 is a side view showing the insert located and secured in the body of the crate with the right hand side of the Figure being a cross-section on line VIII—VIII in FIG. 7.

The crate insert 14 is designed to be located in the cavity of the body as shown in FIGS. 7 to 9. The ribs 28.1 of formations in the body and grooves 32.1 of formations 32 in the pillars 14.2 serve for connecting the body and insert to one another. The formations thus serve as complementary formations to locate and releasably secure the crate insert with respect to the body.

A flat hand grip panel 36 extends between those pillars which are located on opposite sides of the hand grip openings so in the end walls 24.1. The panel contains an opening which is slightly smaller than the hand grip opening 30 and has a peripheral rim 36.1 which fits snugly into the hand grip opening at each end of the crate insert to further locate the insert.

When the crate insert is properly located in the body in the manner described above the bottom of each pillar 14.2 rests on a respective platform 22.1 of the body to support the pillar. The top of each pillar is located so that the upper surface of the platforms 32.4 of the pillars are level with the top of the body.

To enable each pillar to sit securely on a respective platform 22.1, each pillar has a lower part 14.4 of reduced cross-sectional area and the body is provided with sockets 22.2 to receive and locate the lower parts 14.4 of the pillars.

The arrangement is therefore such that when the crate is stacked on another similar crate and supports a higher crate, the base of the higher crate fits into the upper part of lower crate with the connecting strip 26 encircled by the upper part of the wall 24 of the lower crate. The platforms 22.1 of the higher crate rest on platforms 32.4 of the pillars of the lower crate. In the same way, the platforms 22.1 of the lower crate can rest on the platforms 32.4 of the pillars 14.1 of a subjacent crate. The pillars and platforms of the stacked crates thus form a composite load bearing pillar construction in the form of load bearing columns enabling lower crates to support higher crates in the stack.

Because of the way in which the insert is constructed and located, the spacer arrangement 14.1 of the crate is located in the upper part of the cavity provided by the crate body and is therefore suitably above the floor of the body for keeping the upper parts of bottles in the crate separated from one another. In this regard, it will be seen that in some places the crate insert and the walls of the body jointly define openings into which bottles can fit. Elsewhere, the crate insert has circular openings for receiving and encircling bottles.

In order to provide the crate insert with suitable strength for supporting the body against excessive flexing, the insert is provided throughout a substantial part of its structure with an inverted generally concave V-shaped cross-section having a grid of strengthening webs 40. As the crate insert securely engages the formations 28 and is supported by the pillars 14.1 suitable construction of the crate insert can provide the crate with considerably rigidity. This is achieved without the need for a heavy body construction which can use up considerably more material.

Crate bodies of a particular size and shape can be used with a range of inserts so that different bottles or other containers can be transported.

I claim:

1. A crate having a body defining a cavity for receiving a plurality of containers and including a base defining a floor on which the containers can be supported and a plurality of support platforms spaced above and connected to the floor so as to define downwardly opening recesses; the crate also including a removable crate insert located wholly or substantially wholly in the cavity of the body and providing a spacer arrangement suitably above the floor of the body for separating containers in the crate from one another in normal use, the crate insert having a plurality of load-bearing pillars which rest on and extend upwardly from upper surfaces of the support platforms for the entire or substantially the entire height of the body, the load-bearing pillars and the body being configured such that when the crate is located in a stack of such crates, the upper ends of the load-bearing pillars of a subjacent crate are received in said downwardly opening recesses and abut the lower surfaces of the support platforms so as to form a composite load-bearing pillar construction in which the load-bearing pillars of the crates in the stack are longitudinally aligned.

2. A crate according to claim 1, wherein the spacer arrangement of the crate insert is located in the upper half of the crate and alone or together with the body defines openings for receiving containers.

3. A crate according to claim 1, wherein the crate body is made as a relatively thin-walled body of plastics material, and the crate insert is shaped and constructed so that, where it extends from one wall of the crate body to another, it has reinforcing to provide the body with suitable support against flexing.

4. A crate according to claim 1, wherein the body and the crate insert are provided with complementary formations for enabling the crate insert to be located with respect to the body.

5. A crate according to claim 4, wherein the body has hand grip openings and one insert means which fit snugly into the openings to further locate the insert.

6. A crate according to claim 4, wherein the body formations engage and locate crate insert formations on the pillars at least in the upper and lower regions of the crate.

7. A crate according to claim 6, wherein the formations interlock with one another up substantially the whole of the height of the pillars, to locate the pillars with respect to the body and to reinforce the wall structure of the body against flexing.

8. A crate according to claim 1, wherein the body has sockets for receiving lower parts of the pillars and locating them on the support platforms.

9. A crate according to claim 1, wherein the base of the crate is dimensioned to fit into the upper part of a subjacent crate when the crate is located in a stack of such crates.

10. A crate body having a body defining a cavity for receiving a plurality of containers and including a base defining a floor on which the containers can be supported, and a peripheral wall structure extending upwardly from the base; the crate also including a removable crate inset located wholly or substantially wholly in the cavity of the body and providing a spacer arrangement suitably above the floor of the body for separating containers in the crate from one another in normal use, the crate insert having load-bearing pillars for forming part of a composite load-bearing pillar construction with pillars of lower and higher crates of a substantially identical construction when the crate is located in a stack of such crates, the body and the insert being provided with complementary interlocking locating formations, the locating formations on the body protruding inwardly from the inner surface of the wall structure and being arranged to define upwardly extending transversely opening grooves, and the locating formations of the insert including corresponding transversely extending shoulders on at least some of the load-bearing pillars, the shoulder being received and held captive within the grooves, thereby to locate the pillars relative to the wall structure and to reinforce the wall structure.

11. A crate according to claim 1, in which the locating formations of the body include pairs of parallel oppositely inwardly facing upwardly extending grooves with the locating formations of the insert including complementary pairs of outwardly facing shoulders on at least some of the loadbearing pillars.

12. A crate according to claim 1, in which at least some of the grooves extend upwardly from the floor over substantially the whole height of the body.

13. A crate according to claim 1, in which the body locating formations include upwardly extending flanges spaced from and connected to the wall structure such that the grooves are defined between the flanges and the wall structure.

14. A crate according to claim 10, in which the body includes sockets for receiving lower parts of the pillars and locating them on support zones.

15. A crate according to claim 14, in which the support zones are defined by support platforms spaced above and connected to the floor so as to define downwardly opening recesses within which the upper ends of the load-bearing pillars of a subjacent crate are receivable when the crate is located in a stack of such crates, the sockets extending upwardly from the support platforms.

16. A crate according to claim 10, in which at least some of the pillars are hollow.

17. A crate as claimed in claim 16, in which the hollow pillars are internally reinforced.

* * * * *